United States Patent [19]

Sullivan

[11] Patent Number: 4,944,478

[45] Date of Patent: Jul. 31, 1990

[54] PORTABLE GRAB BAR

[76] Inventor: John L. Sullivan, 38 Brightwaters Dr., Sound Beach, N.Y. 11789

[21] Appl. No.: 423,953

[22] Filed: Oct. 18, 1989

[51] Int. Cl.[5] ..... A47B 96/06

[52] U.S. Cl. ..... 248/205.7; 211/105.1; 248/205.8; 248/362

[58] Field of Search ..... 248/205.5, 205.8, 205.9, 248/542, 363, 362, 206.2, 206.3, 206.4; 211/105.1, 105.2; 4/611, 576, 577; 294/64.1

[56] References Cited

U.S. PATENT DOCUMENTS

| | | | |
|---|---|---|---|
| 2,242,461 | 5/1941 | Fisher | 4/576 |
| 2,243,794 | 5/1941 | Dunn | 4/576 |
| 2,634,077 | 4/1953 | Van Dusen | 248/205.8 |
| 2,739,632 | 3/1956 | Rodriguez | 248/205.8 X |
| 2,917,104 | 12/1959 | Cottle | 248/188.5 X |
| 3,098,240 | 7/1963 | Fleenor | 4/576 |
| 3,171,627 | 3/1965 | Tapley | 248/188.5 X |
| 3,365,161 | 1/1968 | Deitch | 248/363 X |
| 3,613,208 | 10/1971 | Seberg | 248/363 |
| 4,828,303 | 5/1989 | Soria | 248/206.3 X |

FOREIGN PATENT DOCUMENTS

| | | | |
|---|---|---|---|
| 28449 | of 1909 | United Kingdom | 248/205.8 |

*Primary Examiner*—J. Franklin Foss

*Attorney, Agent, or Firm*—William P. Keegan

[57] ABSTRACT

A portable grab bar that has suction members at each end thereof to permit attachment of the bar to a flat non-porous surface.

4 Claims, 1 Drawing Sheet

PORTABLE GRAB BAR

FIELD OF THE INVENTION

The invention relates to grab bars, and more particularly to a portable grab bar that may be carried by a person requiring the use of such a device and applied to a surface to provide the sole grab bar where none is provided, or which may supplement a permanently installed grab bar by being more conveniently located for the user.

BACKGROUND OF THE INVENTION

The provision of grab bars is becoming more widespread in lodging accomodations, especially in bathroom environments, to assist and aid people with disabilities in using the bathroom facilities. Thus, bath tubs and showers may be provided with permanently mounted grab bars that enable a person to steady himself when getting into or out of the tub or shower or, when mounted adjacent toilet facilities, to provide a support which the person can use to pull himself to a standing position. While their presence is increasing, the provision of grab bars is by no means universal, and disabled or handicapped people often encounter facilities where there are no permanently mounted grab bars. The absence of grab bars increases the hazard to a handicapped or disabled person in using the facility when a grab bar would be a great convenience or safety feature for that person.

GENERAL DESCRIPTION OF THE INVENTION

It is the object of the invention to provide a portable grab bar for use by a handicapped or disabled person.

It is another object of the invention to provide a grab bar that can be carried by a person when traveling and applied to a surface when needed.

It is still another object of the invention to provide a grab bar that can readily be mounted and dismounted from a surface.

It is yet another object of the invention to provide a portable grab bar that is adjustable in length.

In carrying out the invention, there is provided a grab bar having at each end thereof a suction device by which the bar may be attached to a flat, non-porous surface. The bar itself may be a telescoping unit so that its length may be short enough to be carried in an attache case or other piece of luggage and yet extensible to a length suitable for its use.

Features and advantages of the invention may be gained from the foregoing, and from the description of a preferred embodiment thereof which follows.

DETAILED DESCRIPTION OF THE INVENTION

Figures 1, 2, 3, 4:
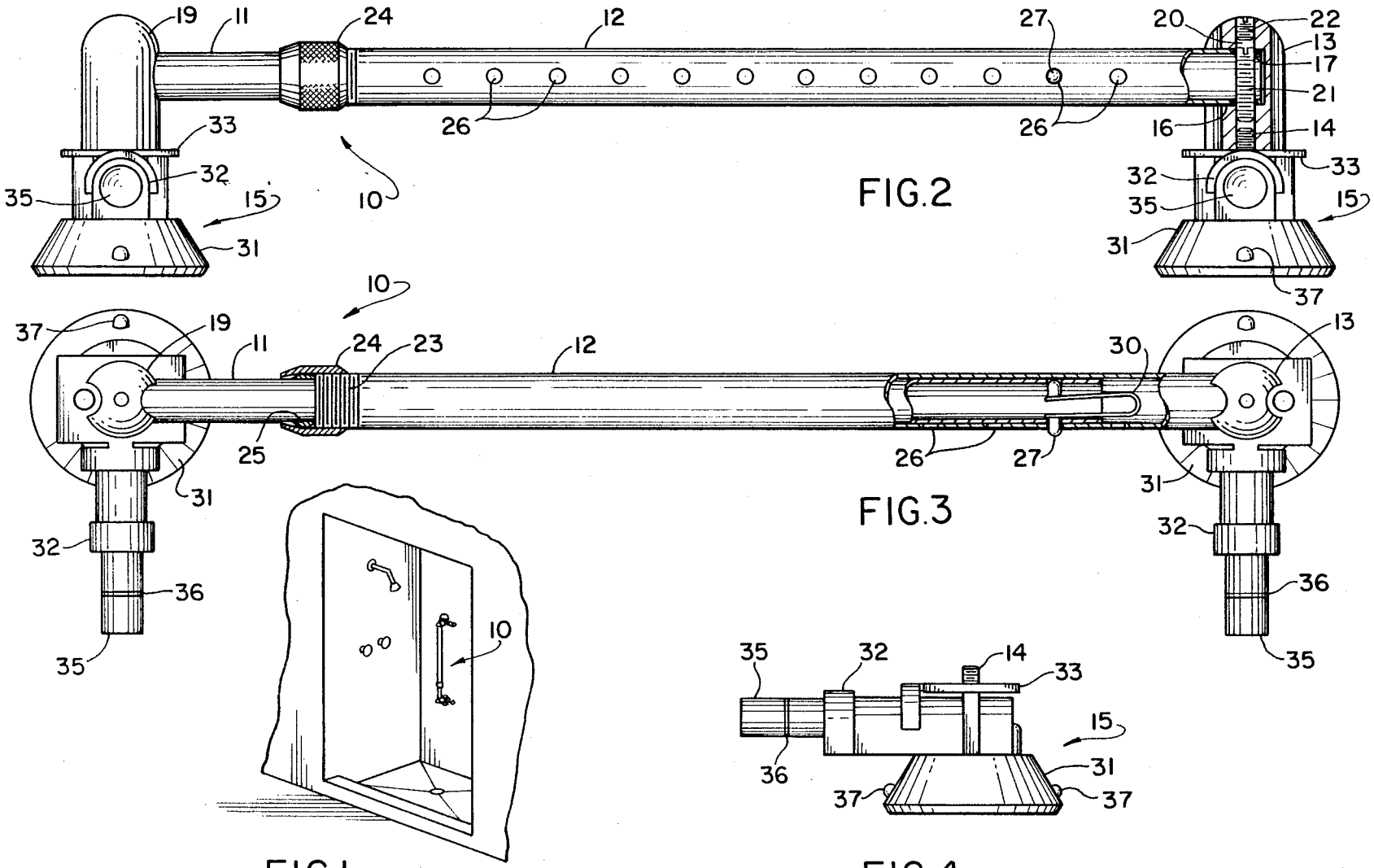
FIG. 1 is a perspective view showing the grab bar of the invention mounted in a shower stall.
FIG. 2 is a front elevational view, partly in section, showing the grab bar of the invention.
FIG. 3 is a top plan view of the grab bar shown in FIG. 2.
FIG. 4 is a side elevational view of a suction device which secures the grab bar to a surface.

In FIG. 1 grab bar 10 is shown mounted in a shower stall. Of course, bar 10 could be mounted in a bathroom or any other room or place where a person desires the support or assistance provided by a grab bar. The bar may be mounted horizontally, diagonally, or with any orientation convenient to the user.

Reference is now made to FIGS. 2 and 3 for a detailed description of grab bar 10. The bar is seen to comprise an inner stainless steel tube 11 that slides within outer tube 12, also formed of stainless steel. Outer tube 12 is secured within end post 13 which itself is threaded onto stud 14 of the suction device 15. This device will be further described hereinafter when FIG. 4 is considered.

As shown in the sectional portion of FIG. 2, the end of tube 12, which is fitted into the bore 16 formed in post 13, is provided with a pair of opposed apertures 17. In assembling grab bar 10, these apertures 17 are aligned with the threaded screwhole 20 which extends axially through end post 13. A set screw 21 is threaded into screwhole 20 and through both apertures 17, thereby securing tube 12 in end post 13. A second set screw 22 is threaded into screwhole 20 flush with the top surface of post 13. Inner tube 11 is similarly secured in the other end post 19.

The free end of tube 12 (that is, the end remote from post 13) is threaded, as at 23, so that a knurled lock nut 24 can be threaded thereon. Nut 24 slides freely on inner tube 11, and as previously noted tube 11 slides freely within outer tube 12, but when nut 24 is threaded onto tube 12 it jams the grommet 25 against the end of the tube 12 and locks inner tube 11 and tube 12 in the relative position they are in when nut 24 is tightened. In this way, the length of grab bar 10 can be freely adjusted to substantially the combined lengths of tubes 11 and 12.

In addition to the length adjusting arrangement just described, tube 12 may be provided with a series of spaced apart linearly aligned apertures 26 which serve as detents for pawl 27 carried by inner tube 11. The pawl is biased into a locking position in engagement with one of apertures 26 by a spring 30. It will be noted that when pawl projects through an aperture 26, the sidewall of the pawl is perpendicular to the axis of tube 12 and therefore inner tube 11 cannot slide within tube 12. However, when pawl 27 is depressed, as by finger pressure applied thereto, the rounded tip of pawl 27 engages aperture 26 and tubes 11 and 12 can be moved relative to one another until pawl 27 is spring biased and fully extended through another aperture 26.

Either or both of the described arrangements for locking grab bar 10 in an adjusted length may be used.

The suction device 15 (FIG. 4) which is preferred for use in grab bar 10 is marketed by Wood's Power Grip Co., Inc. of Wolf Point, Mont., and comprises a suction cup 31, a vacuum pump 32, mounting plate 33, and threaded stud 34. The device shown in the drawing is Model TL3-AM vacuum grip with accessory mount. The suction device may be used on any relatively smooth, non-porous surface that does not provide an air passageway under the edge of suction cup 31.

In use, the length of grab bar is adjusted so that the suction cup of each suction device 15 may be placed on a smooth, non-porous surface. Thus, if the grab bar is to be used in a tiled bathroom, its length is adjusted so that each suction cup is placed on an individual tile and does not overlay any grout joint. The suction cup is then pressed against the tile and spring biased plunger 35 of pump 32 repeatedly depressed until the suction indicating mark 36 on plunger remains below the top edge of the pump barrel. If the suction cup begins to leak air so that plunger 35 is spring biased out of the pump barrel and mark 36 becomes visible, adequate suction can be restored by again repeatedly depressing plunger 35. When it is desired to remove grab bar from the surface to which it is mounted, an edge of the suction cup 31 can be raised with a finger to allow air to leak under the edge of the cup, thus destroying the vacuum holding the cup to the surface. A tab 37 may be provided on the outer surface of cup 31 to facilitate lifting of the edge of the cup when it is desired to remove the grab bar 10 from a surface.

After removal of the grab bar from a surface, the bar will generally be adjusted to its most compact length so that it may be conveniently stored, or packed in the luggage of a traveller. As mentioned earlier, the disclosed grab bar is especially suited to the needs of disabled persons who travel and often encounter travel accommodations that do not have grab bars where they may be required by the disabled person.

Having thus described the invention, it is to be understood that many apparently different embodiments may be made without departing from the spirit and scope of the invention. For example, each suction device 15 may include more than one suction cup so that the grab bar may be used on a tiled surface using smaller tiles. In such a case, a large suction cup would span a grout joint which would prevent the suction cup adhering to the surface. Smaller suction cups would each individually cover a tile but would not span any grout joint. More than one suction cup would be required to provide the adhering force necessary to adequately support a person using the grab bar. Therefore, it is intended that the foregoing description and the accompanying drawing be interpreted as illustrative and not in a limiting sense.

What is claimed is:

1. A portable grab bar for use by a person requiring the aid of such a device for support, said grab bar comprising, in combination: bar means; a first suction means secured to one end of said bar means having a suction member and an integral manually operated spring biased vacuum pump for evacuating air from under said suction member when adhering said first suction means to a surface; a second suction means secured to the other end of said bar means having a suction member and an integral manually operated spring biased vacuum pump for evacuating air from under said suction member when adhering said second suction means to a surface; the arrangement being such that said bar means is supported parallel to and spaced from a surface to which said suction members are adhered; and indicator means provided on each of the aforesaid vacuum pumps by which a user of the grab bar is warned when the pressure adhering a suction means to a surface may not be sufficient to support an additional force applied to the grab bar by a person using the grab bar.

2. A portable grab bar according to claim 1 wherein said bar means comprises a first tubular bar member slideably positioned within a second tubular bar member so that the length of said bar means may be adjusted substantially anywhere from the length of said second bar member to the combined length of of said bar members, and means for locking said bar members in their adjustable length positions.

3. A portable grab bar according to claim 2 wherein said locking means comprises a series of linearly spaced apertures in said second bar member, and a spring biased pawl carried by said first bar member for engaging an aperture in said second bar to lock said bar members in that adjusted position.

4. A portable grab bar according to claim 2 wherein said second bar member is externally threaded at the end where said first bar member slides into said second bar member, and wherein said locking means comprises grommet means loosely fitted over said first bar member and a locking nut that is threadable onto the threaded end of said second bar member to wedge said grommet means between said bar members and lock said bar members in an adjusted position.

* * * * *